US012084830B2

(12) United States Patent
Yousef

(10) Patent No.: US 12,084,830 B2
(45) Date of Patent: Sep. 10, 2024

(54) CUTTER HEAD WITH SUCTION FUNCTION AND A METHOD FOR USING SAME

(71) Applicant: Dredge Yard DMCC, Dubai (AE)

(72) Inventor: Basel Yousef, Rotterdam (NL)

( * ) Notice: Subject to any disclaimer, the term of this patent is extended or adjusted under 35 U.S.C. 154(b) by 0 days.

(21) Appl. No.: 16/617,612

(22) PCT Filed: May 31, 2018

(86) PCT No.: PCT/NL2018/050356
§ 371 (c)(1),
(2) Date: Nov. 27, 2019

(87) PCT Pub. No.: WO2018/222039
PCT Pub. Date: Dec. 6, 2018

(65) Prior Publication Data

US 2020/0173142 A1 Jun. 4, 2020

(30) Foreign Application Priority Data

May 31, 2017 (NL) ..... 2019004

(51) Int. Cl.
*E02F 3/90* (2006.01)
*E02F 3/92* (2006.01)

(52) U.S. Cl.
CPC ..... *E02F 3/9231* (2013.01); *E02F 3/905* (2013.01); *E02F 3/907* (2013.01); *E02F 3/9237* (2013.01); *E02F 3/9243* (2013.01); *E02F 3/9293* (2013.01)

(58) Field of Classification Search
CPC ..... E02F 3/9231; E02F 3/905; E02F 3/907; E02F 3/9237; E02F 3/9243; E02F 3/9293; E02F 3/9225
See application file for complete search history.

(56) References Cited

U.S. PATENT DOCUMENTS 365,140 A * 6/1887 Lynch ..... E02F 3/9231 37/327
372,956 A * 11/1887 Bowers ..... E02F 3/9231 37/327

(Continued)

*Primary Examiner* — Edwin J Toledo-Duran
(74) *Attorney, Agent, or Firm* — Wilcox, Myers, & Jones, P.C.; Jeffrey D. Myers

(57) ABSTRACT

The invention relates to a cutter head for removing a mixture comprising water and solid materials from a water bottom, comprising rotating blades each provided with cutting means on a leading edge thereof, said cutter head being rotatably coupled to a tube for transporting said mixture, the shape of the leading edge of said rotating blades being defined by substantially fitting a rounded cone with a rotation axis, wherein each rotating blade at a middle part is coupled to a connecting ring and at a top part is linked to a top part of another rotating blade. The cutter head is characterized in that the rotation axis of said blades is substantially aligned with a rotation axis of said ring; in that a trailing edge of part at least one of said blades is positioned closer to said rotation axis than a leading edge of said blades so as to provide a suction function towards said tube upon rotation of said cutter head; and in that said blades as viewed from said top part at a bottom part of said blades extend to a position beyond said connecting ring. A preferred embodiment comprises a method for using the cutter head according to the invention.

10 Claims, 2 Drawing Sheets

(56) References Cited

Figure 1:
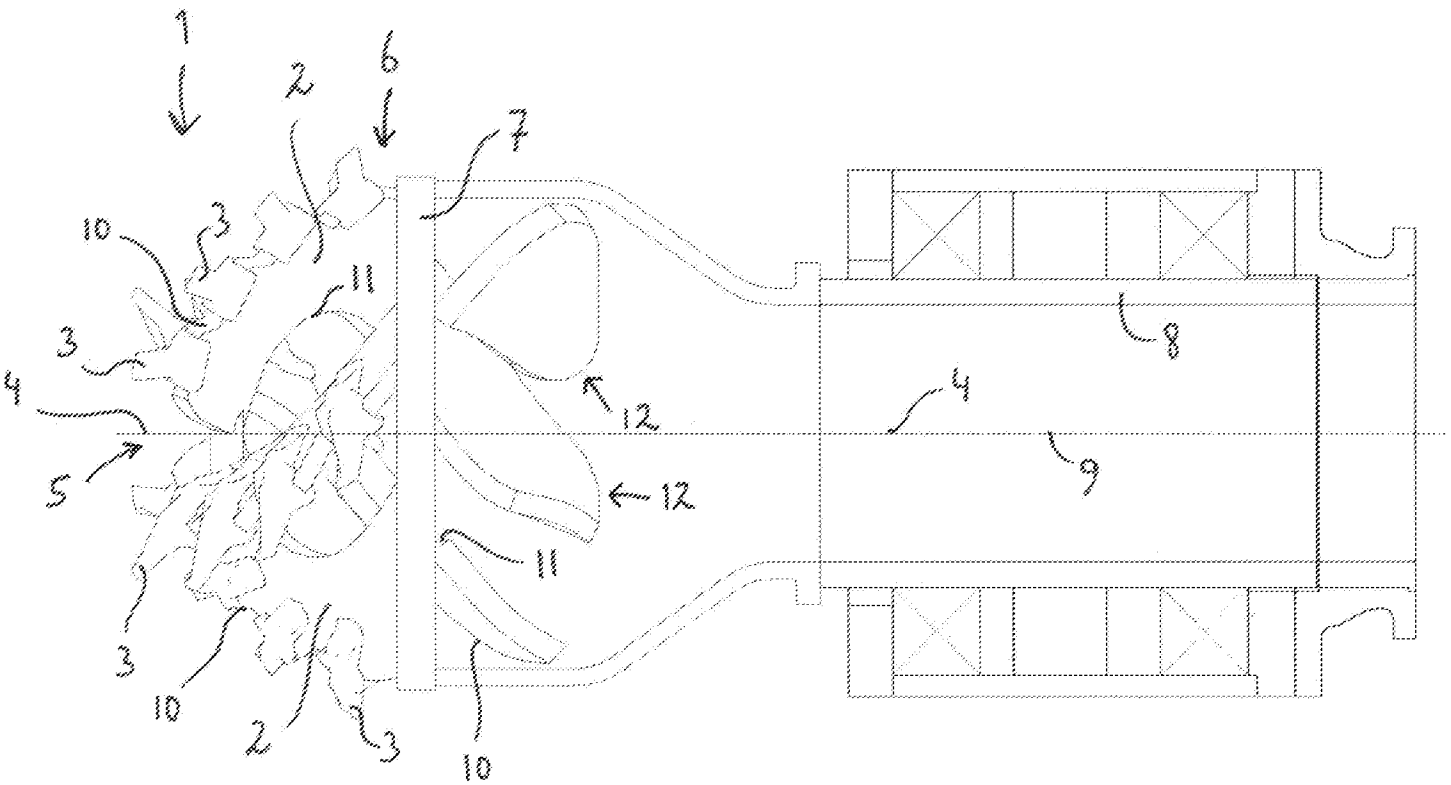

U.S. PATENT DOCUMENTS 506,354 A * 10/1893 Yerrington ..... E02F 3/9231 37/327
637,831 A * 11/1899 Robinson ..... E02F 3/9231 37/327
682,024 A * 9/1901 Bradley ..... E02F 3/9231 37/327
725,818 A * 4/1903 Bates ..... E02F 3/925 37/326
727,691 A * 5/1903 Robinson ..... E02F 3/9231 37/327
777,180 A * 12/1904 Cantwell ..... E02F 3/9231 37/327
805,965 A * 11/1905 Jones ..... E02F 3/9231 37/325
832,345 A * 10/1906 Smulders ..... E02F 3/9231 37/327
892,977 A * 7/1908 Cantwell ..... E02F 3/9231 37/327
1,436,015 A * 11/1922 Cushing ..... E02F 3/9287 37/327
1,477,352 A * 12/1923 Hughes ..... E02F 3/9293 37/327
1,821,177 A * 9/1931 Ellis ..... E02F 3/9293 37/327
1,840,025 A * 1/1932 Daniels ..... E02F 3/9231 37/327
1,861,349 A * 5/1932 Lockett ..... E02F 3/9231 37/325
2,002,749 A * 5/1935 Neveling, Sr. ..... E02F 3/9231 37/331
2,029,816 A * 2/1936 Ewing ..... E02F 3/9293 37/327
2,090,790 A * 8/1937 Fray ..... E02F 3/9225 37/327
2,174,323 A * 9/1939 Isbell ..... E02F 3/9293 37/325
2,242,520 A * 5/1941 Grundborg ..... E21C 45/00 37/331
2,340,216 A * 1/1944 Gill ..... E02F 3/9231 175/413
2,352,394 A * 6/1944 Little ..... E02F 3/9231 37/327
2,702,437 A * 2/1955 Cushing ..... A01B 13/12 37/327
2,999,324 A * 9/1961 Ohlhausen ..... E02F 3/9293 37/327
3,148,464 A * 9/1964 Jones ..... E02F 3/9275 415/206
3,429,131 A * 2/1969 Martin ..... E02F 5/108 405/161
3,644,056 A * 2/1972 Wiselius ..... F04D 29/2277 415/72
3,760,518 A * 9/1973 Hamm ..... E02F 3/9231 37/189
3,807,066 A * 4/1974 Proehl ..... E02F 3/9225 37/327
4,255,882 A * 3/1981 Verboom ..... E02F 3/9281 37/329
4,259,795 A * 4/1981 Verboom ..... E02F 3/9237 37/329
4,305,214 A * 12/1981 Hurst ..... F04D 7/04 415/196
4,327,507 A * 5/1982 Volbeda ..... E02F 3/9231 299/81.1
4,373,277 A * 2/1983 Cucheran ..... E02F 3/9293 37/327
4,648,796 A * 3/1987 Maghenzani ..... F04D 7/04 415/218.1
4,702,024 A * 10/1987 Shiba ..... E02F 3/9231 37/327
5,487,644 A * 1/1996 Ishigaki ..... F04D 1/04 415/206
5,617,654 A * 4/1997 Wetta, II ..... E02F 3/9212 37/327
5,927,439 A * 7/1999 Hanns ..... E21B 21/002 184/6.14
6,868,906 B1 * 3/2005 Vail, III ..... E21B 43/103 166/250.15
7,073,868 B1 * 7/2006 Turner ..... E02F 3/241 37/327
8,327,944 B2 * 12/2012 King ..... E21B 12/00 166/117.5
10,087,601 B2 * 10/2018 Breken ..... E02F 3/9231
2005/0183892 A1 * 8/2005 Oldham ..... E21B 7/20 175/402
2005/0268499 A1 * 12/2005 Weinrib ..... F04D 7/045 37/326
2006/0124306 A1 * 6/2006 Vail ..... E21B 33/14 175/57
2008/0073125 A1 * 3/2008 Eason ..... E21B 10/46 175/432
2010/0175926 A1 * 7/2010 Buske ..... E21B 10/50 175/374
2011/0283569 A1 * 11/2011 Redding ..... E02F 3/9206 37/344
2011/0315051 A1 * 12/2011 Olsen ..... C22C 29/06 106/286.6
2015/0060072 A1 * 3/2015 Busby ..... C09K 8/92 166/305.1
2015/0275473 A1 * 10/2015 Van Opstal ..... E02F 3/9231 37/343
2015/0377254 A1 * 12/2015 Pol ..... F04D 13/08 415/121.2
2016/0107733 A1 * 4/2016 Thomson ..... F04D 29/4206 417/53

* cited by examiner

CUTTER HEAD WITH SUCTION FUNCTION AND A METHOD FOR USING SAME

The present invention relates to a cutter head according to the preamble of claim 1. According to another aspect, the invention also relates to a method for using said cutter head according to claim 10.

It is commonly known in the art to use cutter heads for dredging purposes. The cutter head is used solely for cutting the water bottom. A separate pump, or a plurality thereof, is provided for pumping away the mixture of solid material and water. Dutch patent application NL1012795 and US patent application US2002/0104238 both relate to such cutter head arrangements.

Such known set up has a disadvantage in that the suction action is insufficient if the pump is positioned away too far from the cutter head. Positioning the pump close to the cutter head is no option, since the pump preferably is positioned above water level.

Tendency of most manufacturers is to apply stronger pumps which increases costs.

The invention aims at providing an improved cutter head of the kind mentioned in the preamble.

The invention further aims at providing a cutter head that at least partly eliminates the need for pumps.

So as to obtain at least one of the above mentioned aims, the invention provides a cutter head comprising the features of claim 1. This cutter head has the advantage that a high pumping action is obtained. As a consequence, a pump for transporting the mixture of solid material and water may have a smaller capacity than is required with known cutter heads or may be omitted completely.

It has shown that the cutter head according to the present invention is able to remove substantially all solid material that has been cut loose by the cutter head. Virtually no material is lost. Such synergistic effect is surprising and highly advantageous.

The invention therefore relates to a cutter head for removing a mixture comprising water and solid materials from a water bottom, comprising rotating blades each provided with cutting means on a leading edge thereof, said cutter head being rotatably coupled to a tube for transporting said mixture, the shape of the leading edge of said rotating blades being defined by substantially fitting a rounded cone with a rotation axis, wherein each rotating blade at a middle part is coupled to a connecting ring and at a top part is linked to a top part of another rotating blade. The cutter head is characterized in that the rotation axis of said blades is substantially aligned with a rotation axis of said ring; further characterized in that a trailing edge of part at least one of said blades is positioned closer to said rotation axis than a leading edge of said blades so as to provide a suction function towards said tube upon rotation of said cutter head; and still further characterized in that said blades as viewed from said top part at a bottom part of said blades extend to a position beyond said connecting ring and are positioned partly inside the tube. An additional effect of the cutter head according to the invention is obtained by the said positioning of the trailing edge relatively close to the rotation axis, providing a radial motion to the mixture of solid materials and the water such that said mixture is directed towards the tube. Actually, the action of the blades of the cutter head may be compared with the action of blades of a propeller.

More in particular, due to the fact that the rotating blades extend to a position beyond the connecting ring and as such are positioned partly inside the tube, the mixture of water and solid material is more effectively guided into the tube at a higher velocity so that the solid materials do not fall back towards the cutter head. Clogging is thus effectively prevented. Providing a restriction in the tube close to the cutter head further enhances the transport of the solid material and water into the tube. The restriction may be a venturi-like narrowing. Since the cutter head itself induces a velocity increase to the mixture of solid material and water said mixture automatically follows such venturi shaped narrowing in the tube. A technical designer is easily capable of positioning said narrowing at a correct position in the tube, taking account of the velocity the mixture is transported and the nature of said mixture.

So as to obtain a maximum pumping action by said blades, it is preferred that said leading edge of said blades is directed substantially into a rotation direction of said blades. Since the blades of the cutter head are provided with a trailing edge positioned relatively close to the rotation axis, any mixture can only leave the cutter head through said tube, yielding a pressure inside said tube and as a consequence a positive head to the pumping action.

A smooth operation yielding both a high pumping capacity and an optimum cutting action is obtained when said leading edges of said blades substantially fit said rounded cone. The cutting means then have a good grip on the water bottom to be dredged.

When using the cutter head according to the present invention, solid material and water are pumped away by the cutter head, more in particular due to the specific shape of the blades, wherein said rotating blades comprise a guiding surface between said leading edge and said trailing edge and directed towards a position between said cone and said rotation axis. As a consequence, the mixture is transported from the water bottom to a position inside the cutter head. Overall, it is preferred for the rotating blades to have a smoothly varying surface between the leading edge and the trailing edge.

An excellent operation is provided by a cutter head wherein a trailing edge of said blades near said middle part is positioned at a larger distance from said rotation axis than a trailing edge of said blades near said top part. It has shown that a flow path for said solid material and water is highly enhanced by such embodiment, further decreasing the chance of clogging of the cutter head.

As an alternative embodiment, in the cutter head according to the invention, a trailing edge of said blades near said middle part is positioned at a larger distance from said rotation axis than a trailing edge of said blades near said bottom part.

According to the invention, an efficient pumping action is especially obtained by a cutter head wherein a trailing edge of at least one of said blades at a position near said middle part is positioned closer to said rotation axis than a leading edge of at least one of said blades at a position closer to said top part.

A strong and solid cutter head is obtained when said connecting ring and said tube are connected and mutually rotatably driven. Usually, the connecting ring is coupled to an end of said tube, such that the rotating blades are partly positioned inside said tube.

A sturdy cutter head consists of a set of blades, each blade being connected to said connecting ring and wherein said connecting ring is coupled to the tube, said tube being driven by means of a coaxial motor positioned at an outside of said tube.

According to a further aspect, the invention relates to a method of dredging a water bottom by using a cutter head according to the invention as mentioned above, said method comprising the steps of positioning said cutter head on said water bottom, and rotatably driving a mutually connected tube and said cutter head so as to cut the water bottom and pumping an obtained mixture of solids and water through said tube. The effects and advantages that are obtained with a cutter head as mentioned above can be obtained with this method.

Figure 3:
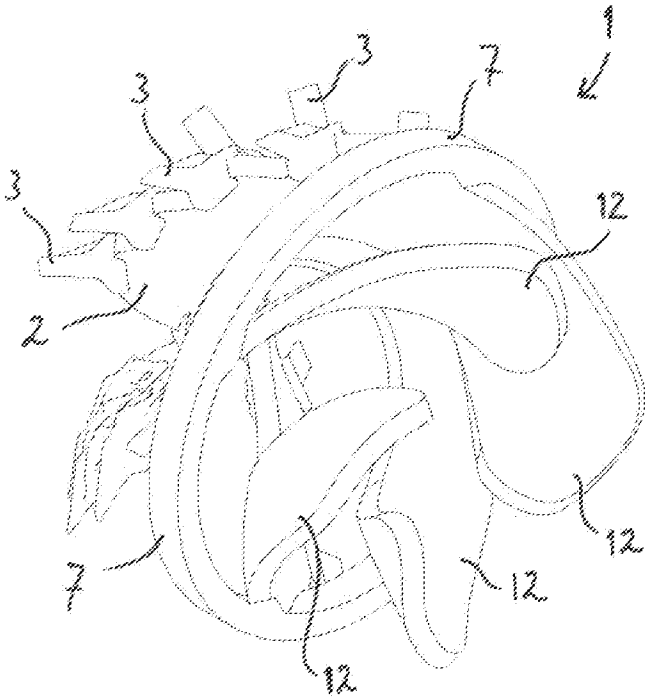
Figure 2:
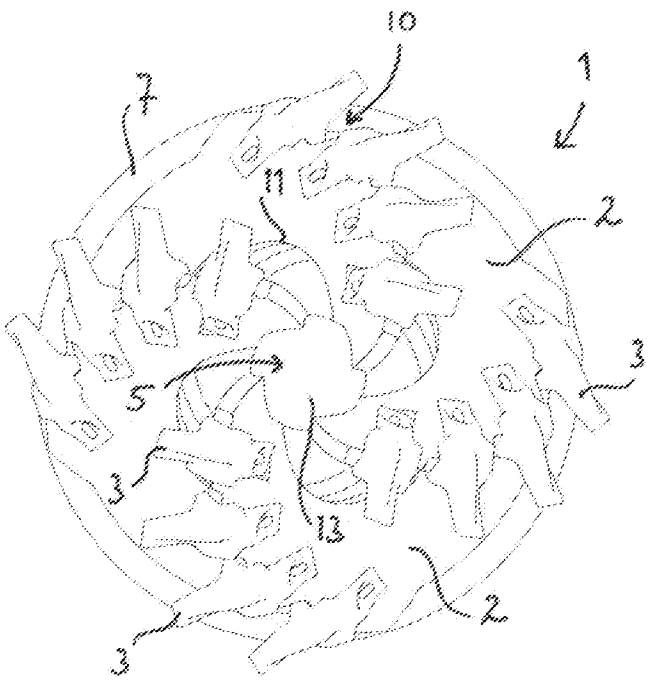

Hereafter, the invention will be further described by means of a drawing. The drawing shows in:

FIG. 1 a partially sectional side view of a cutter head according to the invention;

FIG. 2 shows a perspective bottom view of the cutter head according to FIG. 1; and FIG. 3 shows a top view of the cutter head according to FIG. 1.

The same and similar parts and features of the cutter head according to the present invention have been denoted by the same reference numerals in the figures. However, for ease of understanding the figures, not all parts that are required for a practical embodiment have been shown.

FIG. 1 shows a partially sectional side view of a cutter head 1 for dredging purposes and the like in a water bottom. The cutter head 1 comprises blades 2 to which cutting means 3 are provided for cutting the water bottom. During use, the cutter head 1 is rotated along rotation axis 4 so as to consecutively cut the water bottom by means of said cutting means 3. Generally, cutter heads 1 as shown in the figure are used in dredging for removing sand, rocks and the like from a water bottom. Therefore, a mixture of solid materials and water is obtained, that must be removed from said water bottom.

The blades 2 in the cutter head 1 according to the present invention are embodied somewhat helicoid. A plurality of blades 2 is provided, positioned symmetrically around a rotation axis 4. Each only covers part of a circle if viewed from a position on its rotation axis 4, as schematically shown in FIG. 2. Preferably, each blade 2 is embodied with a rake and skew. As a consequence, the blades 2 are mutually coupled at a first position 5 close to the rotation axis 4, whereas at a second position 6 each blade 2 is connected to a rim 7 (in this description also mentioned connecting ring 7), said second position 6 being further away from the rotation axis 4.

In between said two positions 5, 6, each blade 2 provides a pumping action upon rotation of the cutter head 1, said pumping action being dependent on the rate of rake and skew, the diameter of the blades 2 and the rotational velocity of the cutter head 1.

The blades 2 are coupled to a tube 8, preferably through said rim 7. A rotation axis 9 of said tube 8 is aligned with the rotation axis 4 of said set of blades 2.

Due to the shape of the blades 2, a pumping action is obtained upon rotation of the blades 2. A leading edge 10 is directed into the rotational direction of the cutter head 1 whereas the blades 2 are shaped such that a trailing edge 11 is directing to and situated in a location inside the circumference of the rim 7 of the cutter head 1. As a matter of fact, the trailing edge 11 of each blade is located closer to the rotation axis 4 than the leading edge 10 at a same distance from the rim 7. The blade 2 may bend progressively from the leading edge 10 towards the trailing edge 11, but a uniform bending is possible as well. The pumping action induced by the blades 2 on the mixture of water and solids is dependent on such shape of the blades 2. Furthermore, due to the shape of the blades 2, mixture of water and solid materials is directed towards the inside of the cutter head 1 and therefore directly towards the tube 8, such that all mixture will be transported efficiently. As a consequence, the pumping head provided by the shape of the blades 2 of the cutter head 1 work together with the propelling action of the said blades 2 such that a most efficient effect is obtained. It has shown that the pumping head provided by the cutter head of the present invention may increase significantly. This relieves the regular pump or may even allow shutting off the regular pump. A huge advantage is the cost reduction for pumping gear, if compared with the state of the art.

As shown in FIG. 1, the cutting means 3 are provided on the leading edge 9 of each blade 2.

As mentioned above, FIG. 1 shows a partly sectional side view of the cutter head 1. The rake and skew of each blade 2 are clearly visible in FIG. 1 and also in FIGS. 2 and 3.

The top view of FIG. 2 clearly shows that the blades 2 are mutually connected at first position 5. A connecting member 13 is provided to which all blades 2 are connected at their respective top part.

FIG. 3 clearly shows that part 12 of blades 2 extend to a position beyond the rim 7, if viewed from the first position 5. Part of the blades 2 is placed between said first position 5 and the rim 7 (i.e. second position 6), whereas a remaining part 12 of said blades 2 extend further. It is clear from FIG. 1 that said part 12 is placed inside the tube 8. As a consequence, the mixture of water and solid material is effectively guided into the tube 8. It is not necessary that part 12 also provides a pumping action. It may be sufficient for part 12 to guide said mixture into the tube 8, although some additional pumping action provided by part 12 may help to more effectively transport said dredged mixture.

The invention is not limited to the embodiments as mentioned above and as shown in the drawings. The invention is limited by the claims only.

The invention also relates to all combinations of features described here independently of each other.

The invention claimed is:

1. A cutter head for removing a mixture comprising water and solid materials from a bottom of a body of water, comprising rotating blades each provided with cutting means on a leading edge thereof, said cutter head being rotatably coupled to a tube for transporting said mixture, the shape of the leading edge of said rotating blades being defined by substantially fitting a rounded cone with a rotation axis, wherein each rotating blade at a middle part is fixedly coupled to a single connecting ring and at a top part is linked to a top part of another rotating blade, wherein the single connecting ring is positioned at an outer circumference of the rotating blades;

wherein the rotation axis of said blades is aligned with a rotation axis of said single connecting ring;

wherein a trailing edge of part of at least one of said blades is positioned closer to said rotation axis than a leading edge of said blades so as to provide a suction function towards said tube upon rotation of said cutter head; and wherein said blades as viewed from said top part at a bottom part of said blades extend to a position beyond said connecting ring and are positioned partly inside the tube; and wherein said single connecting ring is coupled to the tube, the tube and the single connecting ring rotating coaxially with respect to rotation of said blades.

2. The cutter head according to claim 1, wherein said leading edge of said blades is directed substantially into a rotation direction of said blades.

3. The cutter head according to claim 1, wherein said leading edges of said blades substantially fit said rounded cone.

4. The cutter head according to claim 1, wherein said rotating blades comprise a guiding surface between said leading edge and said trailing edge and directed towards a position between said cone and said rotation axis.

5. The cutter head according to claim 1, wherein a trailing edge of said blades near said middle part is positioned at a larger distance from said rotation axis than a trailing edge of said blades near said top part.

6. The cutter head according to claim 1, wherein a trailing edge of said blades near said middle part is positioned at a larger distance from said rotation axis than a trailing edge of said blades near said bottom part.

7. The cutter head according to claim 1, wherein a trailing edge of at least one of said blades at a position near said middle part is positioned closer to said rotation axis than a leading edge of at least one of said blades at a position closer to said top part.

8. The cutter head according to claim 1, wherein said single connecting ring and said tube are connected and jointly rotatably driven.

9. The cutter head according to claim 8, wherein said tube is driven by means of a coaxial motor positioned at an outside of said tube.

10. A method of dredging a water bottom by using a cutter head according to claim 1, the method comprising the steps of positioning said cutter head on said water bottom, and rotatably driving a mutually connected tube and said cutter head so as to cut the water bottom and pumping an obtained mixture of solids and water through said tube.

* * * * *